US005931110A

United States Patent [19]

Yamamoto

[11] Patent Number: 5,931,110

[45] Date of Patent: Aug. 3, 1999

[54] VESSEL DIRECTION CONTROL SYSTEM FOR SMALL-SCALE VESSEL

[75] Inventor: Shigeru Yamamoto, Kanagawa-ken, Japan

[73] Assignee: Nissan Motor Co., Ltd., Kanagawa-ken, Japan

[21] Appl. No.: 08/905,341

[22] Filed: Aug. 4, 1997

[30] Foreign Application Priority Data

Aug. 9, 1996 [JP] Japan ..... 8-227871

[51] Int. Cl.[6] ..... B63H 25/02

[52] U.S. Cl. ..... 114/144 E; 114/144 C; 440/6

[58] Field of Search ..... 114/144 C, 144 E, 114/144 B; 440/6, 7

[56] References Cited

U.S. PATENT DOCUMENTS

| | | | |
|---|---|---|---|
| 4,059,064 | 11/1977 | Dickey | 114/144 E |
| 4,728,307 | 3/1988 | Burgess | 440/7 |
| 5,172,324 | 12/1992 | Knight | 114/144 E |
| 5,386,368 | 1/1995 | Knight | 440/6 |
| 5,491,636 | 2/1996 | Robertson et al. | 114/144 B |
| 5,525,081 | 6/1996 | Mardesich et al. | 114/144 E |

FOREIGN PATENT DOCUMENTS 63-196798 12/1988 Japan .

*Primary Examiner*—Sherman Basinger
*Attorney, Agent, or Firm*—McDermott, Will & Emery

[57] ABSTRACT

A fishing boat has a direction sensor disposed at a midship of the boat for detecting as a vessel direction a direction of a bow of the boat, an outboard motor attached to the bow for controlling the vessel direction, and a control unit responsive to a detected vessel direction to control the outboard motor so that the bow is oriented at a preset vessel direction.

3 Claims, 5 Drawing Sheets

VESSEL DIRECTION CONTROL SYSTEM FOR SMALL-SCALE VESSEL

The contents of Application No. TOKUGANHEI 8-227871, filed Aug. 9, 1996, in Japan, which is Laid-Open Publication No. 10-59291, published Mar. 3, 1998, are hereby incorporated by reference.

BACKGROUND OF THE INVENTION

1. Field of the Invention

The present invention generally relates to a system for controlling a direction of a body of a ship, vessel or watercraft (hereafter collectively "vessel"), and particularly, it relates to a vessel direction control system for a small-scale vessel such as a fishing boat.

2. Description of Relevant Art

There has been proposed in Japanese Utility Model Application Laid-Open Publication No. 63-196798 a vessel direction control system for small-scale vessels, which comprises a wind direction detecting means for detecting a direction of winds above a small-scale vessel, a vessel direction controlling outboard motor attached to a bow or stern of the vessel, and a control means responsive to the detected wind direction to control a direction of a propulsive force of the outboard motor so that the bow is always oriented upstream the winds.

The conventional vessel direction control system is adapted to detect a direction and a pressure of winds above a small-scale vessel, and is responsible for the result to control the outboard motor to keep a vessel direction so that a bow is always oriented upstream the winds.

As winds change with time, the bow is oriented at a varying direction.

The conventional vessel direction control system thus fails to exhibit a desirable performance in application to a small-scale vessel for a fishing that needs a bow to be oriented at a fixed direction irrespective of a direction or a pressure of winds, like a bass fishing on a boat.

SUMMARY OF THE INVENTION

The present invention has been achieved with such points in view.

It therefore is an object of the present invention to provide a vessel direction control system for a small-scale vessel, permitting a body of the vessel to be controlled to have a bow always oriented at a direction irrespective of a wind direction or a wind pressure.

To achieve the object, an aspect of the invention provides a vessel direction control system for a small-scale vessel including a vessel body with a bow and a stern, the vessel direction control system comprising a detector for detecting a direction of the vessel body as a vessel direction, an outboard motor attached to one of the bow and the stern for controlling the vessel direction, and a controller responsive to a detected vessel direction to control the outboard motor so that the bow is oriented at a preset vessel direction.

According to the aspect, a detector detects as a vessel direction a direction of a vessel body that may be given e.g. in terms of an azimuth of a bow or a stern of the vessel body or a relative position of the vessel body to a convenient reference object, and a controller controls an outboard motor in consideration of a detected value of the vessel direction so that the bow is oriented at a preset vessel direction.

As the bow is kept oriented at a direction, the vessel body has a vessel direction maintained irrespective of a wind direction, a wind pressure, or a flow direction of water on which the vessel body is lying.

There can thus be achieved a favorable effect in application to a small-scale vessel for a fishing, in particular to a boat for a bass fishing.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
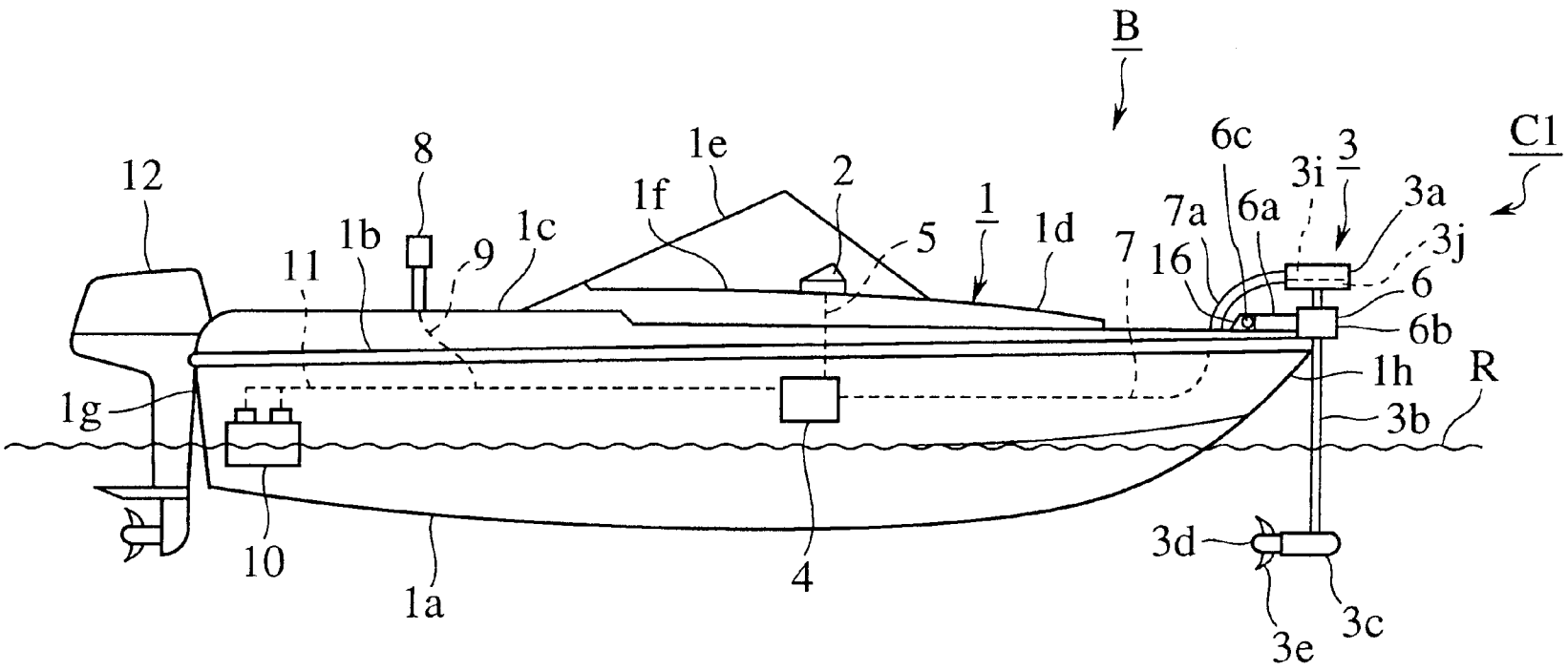
FIG. 1 is a side elevation of a fishing boat with a vessel direction control system according to an embodiment of the invention.

There will be detailed below the preferred embodiments of the present invention with reference to the accompanying drawings. Like members are designated by like reference characters.

FIG. 1 is a side elevation of a boat as a small-scale vessel with a vessel direction control system according to a first embodiment of the invention.

In FIG. 1, designated by reference character B is an entirety of the boat, C1 is an entirety of the vessel direction control system according to the first embodiment, and R is water at a fishing spot of a river or lake or on the sea.

The boat B comprises a vessel body 1 equipped with the vessel direction control system C1 and an aft outboard engine 12 as a main propelling unit including an integral helm steerable by an unshown tiller.

The vessel body 1 comprises a hull 1*a* defining a cockpit 1*c* with a single midship pilot seat and a hold, a steering instrument panel 1*d* detachably fastened to the hull 1*a,* and a wind shield 1*e* detachably attached to the instrument panel 1*d.*

The hull 1*a* has a bow 1*h* as a right ahead, a starboard side 1*b,* a port side, a stern 1*g* as a right aft, and an upper deck extending along peripheries of a forward part and an aft part thereof.

The vessel direction control system C1 comprises a direction sensor 2 disposed substantially at a midship of the vessel body 1 for detecting a vessel direction of the vessel body 1 in terms of an azimuth of the bow 1*h* about the midship to output an electric direction signal, an electric outboard motor 3 as an auxiliary propelling unit attached to the bow 1*h* for controlling the vessel direction of vessel body 1, and a control unit 4 responsive to the detection signal from the direction sensor 2 to control a combination of a magnitude and a direction of a propulsive force of the outboard motor 3 so that the vessel direction of vessel body 1 (i.e. azimuth of bow 1*h*) is automatically maintained at a voluntary azimuth preset to the control unit 4.

The direction sensor 2 comprises an omnidirectional azimuth sensor, such as a geomagnetism-sensitive magnetic compass or a north-indicative gyroscopic compass, that has an azimuth detection range of 360° about the midship of vessel body 1.

A detected direction of vessel body 1 is converted into an electric signal, which is output as the detection signal via electric harness 5 to the control unit 4.

The outboard motor 3 is secured to the bow 1*h* by a bracket 16 in a later-described manner.

The outboard motor 3 is designed as a helmless low noise light-weight electric propelling unit that has a pair of electric motors each respectively controllable in both drive direction and rotation speed to control a direction and a magnitude of a propulsive force for the boat B as a small-scale vessel.

The boat B has a radio receiver for receiving various meteorological data including data on a water velocity, i.e. a speed and a direction of an associated flow of water R, and a wind force, i.e. a representative pressure and a representative direction of winds at the fishing point. The boat B may have a water flow sensor for detecting a representative speed and a representative direction of associated streams of a flow of water R on which the boat B is lying.

Preferably, the outboard motor 3 may be employed for such a detection in a later-described manner.

The boat B is provided with a measure for checking a current place of its location in a geographic region.

The control unit 4 comprises a microcomputer composed of a CPU (central processing unit) and peripheral equipment including a ROM (read only memory), a RAM (random access memory), combinational logic circuitry and an I/O (input/output) interface, and necessary software programs stored in the ROM and RAM.

The control unit 4 is electrically connected via harness 7 to the outboard motor 3, via harness 9 to an operation terminal 8, and via harness 11 to a battery 10. The operation terminal 8 has a display with operation switches and a keyboard for setting in advance a set of basic data including a current location of boat B and an azimuth of bow 1*h* of vessel body 1 to be kept for a fishing, a velocity of an associated flow of water R, an associated wind velocity, a residual capacity of the battery 10, a net load of the boat B, etc.

The control unit 4 has a set of necessary data input thereto, stored in the RAM and updated, from time to time, including the basic data, a set of performance curves of the outboard motor 3 and the engine 12, etc.

Basically, the control unit 4 processes the detection signal from the direction sensor 2 together with necessary read data, calculating a variation of the detected vessel direction as an angular difference relative to a preset azimuth of the bow 1*h*, computing a direction and a magnitude of a necessary propulsive force for cancellation of the angular difference, outputting a correspondent control signal to the outboard motor 3, while the main engine 12 that is too noisy for the fishing is stopped.

Figure 2:
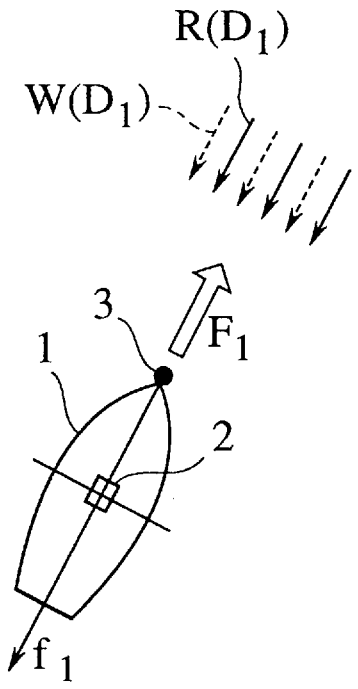
FIG. 2 is an illustration describing a function of the control system of FIG. 1, as a flow direction of water coincides with a wind direction.
Figure 3:
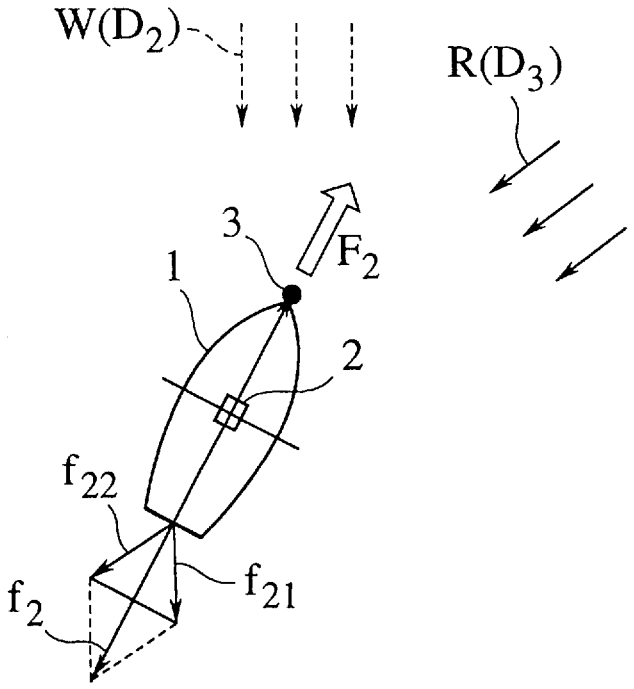
FIG. 3 is an illustration describing a function of the control system of FIG. 1, as a flow direction of water crosses a wind direction.

FIGS. 2 and 3 are illustrations describing functions of the control system C1.

In the illustration of FIG. 2, a flow direction D1 of streams of water R coincides with a direction D1 of winds W. The vessel body 1 of boat B has the bow 1*h* oriented upstream the water R and winds W. This vessel direction is checked by the direction sensor 2. An external force f1 due to a combination of streams of water R and winds W is balanced with a propulsive force F1 produced by the outboard motor 3. The boat B as a small-scale vessel is thus kept oriented at a preset direction (−D1), staying at a preset location.

In the illustration of FIG. 3, streams of water R have a flow direction D3 different of a direction D2 of winds W. The vessel body 1 of boat B has the bow 1*h* oriented at an adequate medium direction between the directions D2, D3 of streams of water R and winds W. The winds W impose an external force f21 on the vessel body 1 in the direction D2. The streams of water R impose an external force f22 on the vessel body 1 in the direction D3. A resultant force f2 of the external forces f21 and f22 is balanced with a propulsive force F2 produced by the outboard motor 3. The boat B is thus kept oriented at a preset direction, staying at a preset location.

Figure 4:
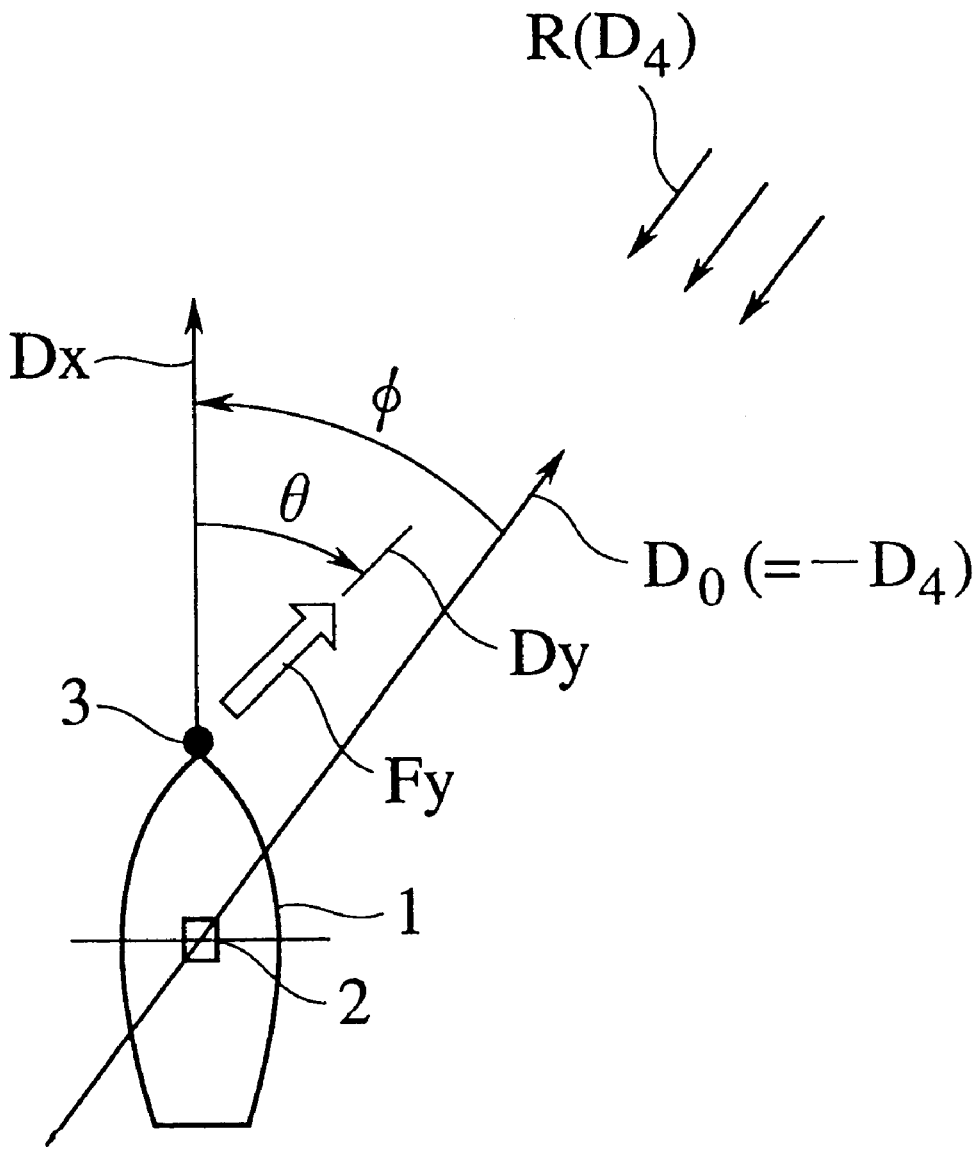
FIG. 4 is an illustration describing a principle of vessel direction control of the control system of FIG. 1.

FIG. 4 is an illustration describing a principle of vessel direction control of the control system C1.

First, the outboard motor 3 is manually controlled through the operation terminal 8 so that the bow 1*h* of vessel body 1 is oriented at an adequate direction D0, e.g. upstream a flow of water R flowing in a direction D4=−D0, and an optimum propulsive force is produced. Then, associated manual control data are input from the terminal 8 to the control unit 4, before selecting an automatic control mode.

Thereafter, the vessel direction may change for some reason, with the bow 1*h* oriented at a direction Dx deviated from the preset direction D0 by an angular difference $\phi$.

In such a case, the outboard motor 3 is controlled by the control unit 4 to have a restoring propulsive force Fy developed in a direction Dy at a return angle $\theta$ so that the bow 1*h* is restored at the preset direction D0.

Figure 5:
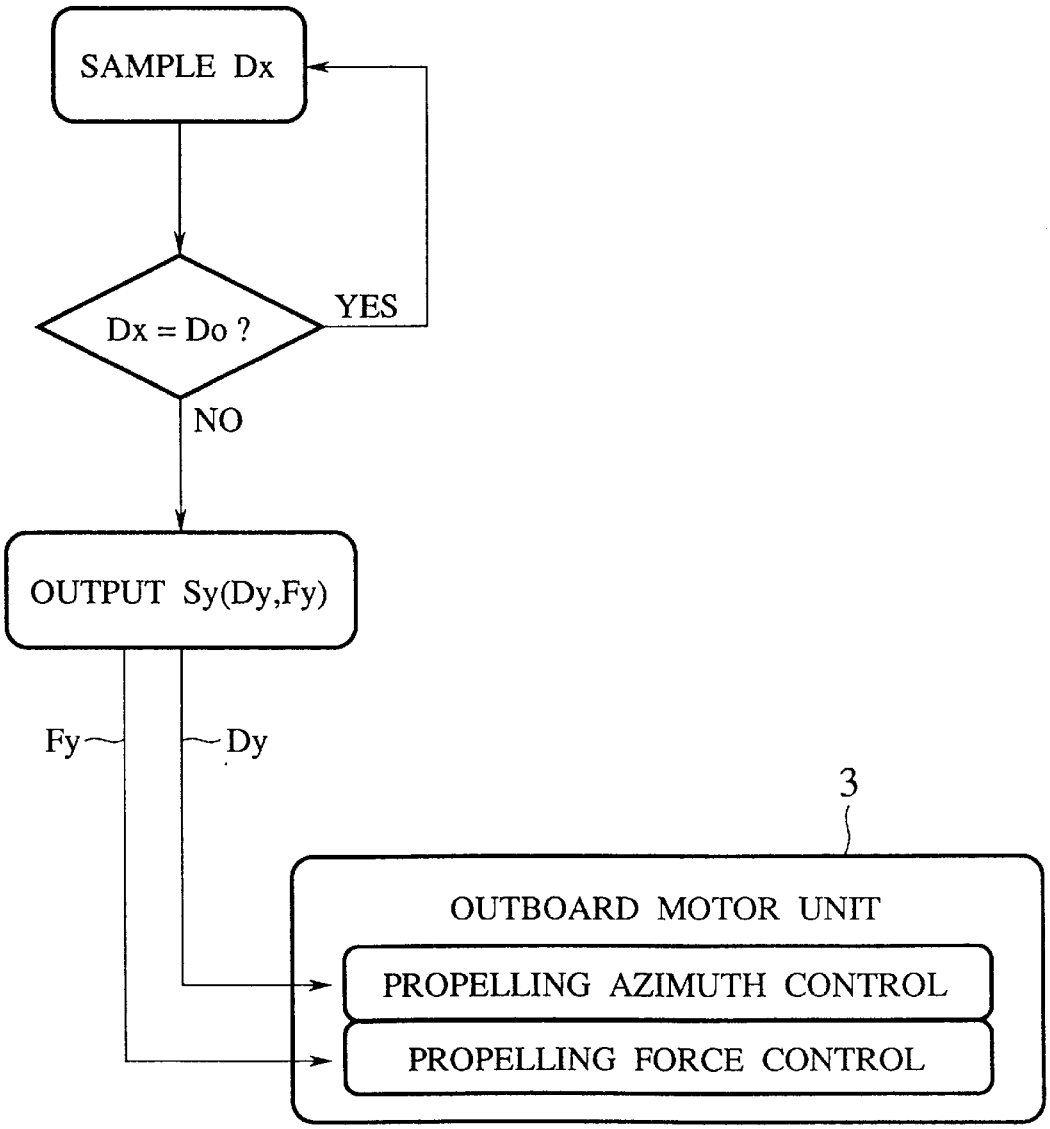
FIG. 5 is a flow chart of actions of the control system of FIG. 1.

FIG. 5 is a flow chart of actions of the control system C1.

After arrival at the fishing point, a steering person stops the main engine 12, and operates the outboard motor 3 to have the vessel body 1 staying at an adequate location with the bow 1*h* oriented at an adequate direction for a convenient fishing. Data associated with the location and direction are input from the operation terminal 8 to the control unit 4.

The direction sensor 2 composed of a magnetic compass or gyroscopic compass then detects a vessel direction Dx in terms of an azimuth of the bow 1*h* about the midship, which represents an angular difference from a preset direction D0 and is converted into an electric signal to be output to the control unit 4, where it is sampled.

The control unit 4 compares the detected direction Dx with the preset direction D0, checking for a deviation therebetween. If the bow 1*h* is oriented at a deviated direction (Dx≠D0) due such as to a wind direction or water flow, the unit 4 performs a calculation on the basis of detection data to determine a pair of correction signals with magnitudes Dy and Fy proportional to the angular deviation and a necessary propulsive force.

The control unit 4 thus outputs a direction control signal (Dy) and a propulsive force control signal (Fy) to the outboard motor 3, where the two electric motors, one for controlling a propelling azimuth and the other for controlling a propelling force, are thereby controlled in drive direction and rotation speed so that the bow 1*h* is restored at the preset direction and the vessel body 1 is held at a preset location.

Figure 6:
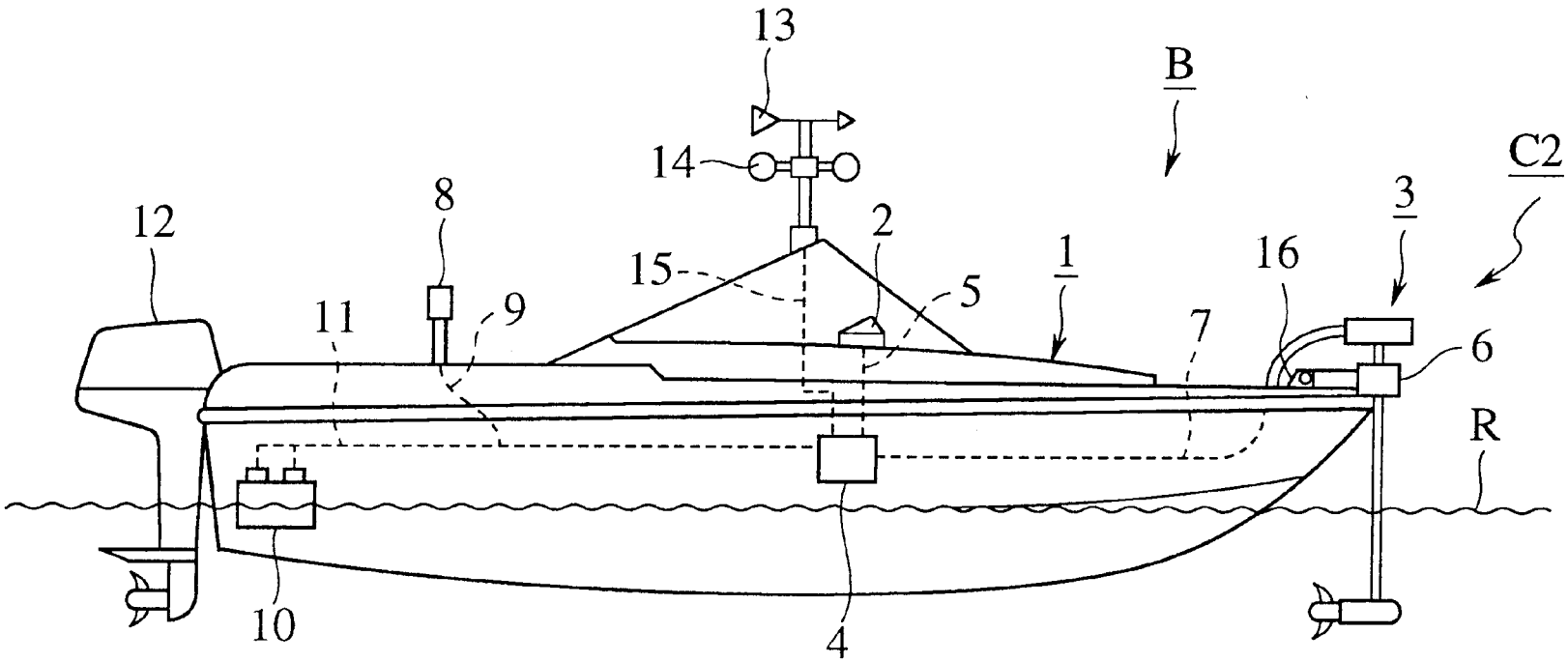
FIG. 6 is a side elevation of a fishing boat with a vessel direction control system according to another embodiment of the invention.

FIG. 6 is a side elevation of a fishing boat B as a small-scale vessel with a vessel direction control system C2 according to a second embodiment of the invention.

This control system C2 is different from that control system C1 in that a wind direction sensor 13 and a wind force or wind pressure sensor 14 are disposed near a direction sensor 2 at a midship of a vessel body 1 and are connected via harness 15 to a control unit 4, and that an operation terminal 8 has an unshown mode select switch for selecting one of the direction sensor 2 and a combination of wind direction and pressure sensors 13, 14 to input a vessel direction signal or a wind velocity signal as a direction signal to the control unit 4.

When the direction sensor 2 is selected, the control system C2 is analogous to the control system C1.

When the combination of sensors 13, 14 is selected, the control system C2 performs an automatic control to have a bow of the vessel body 1 kept oriented upstream winds above the vessel body 1.

The control system C2 thus permits a vessel direction control in accordance with an intended fishing, allowing for a fishing with a certain relationship kept to a wind direction, as well.

In the foregoing embodiments, as best shown in FIG. 1, the outboard motor 3 comprises a motor box 3*a,* and a propeller assembly which is composed of a propeller shaft 3*d* extending in a horizontal direction in water R, a number of propeller elements 3*e* fixed on the propeller shaft 3*d,* a streamlined shaft holder 3*c* for rotatably holding the propeller shaft 3*d* in a watertight sealing manner, a relatively long tubular propeller support 3*b* extending in a vertical direction at the right ahead, enclosing an unshown drive belt, and connected watertight to the shaft holder 3*c,* and a propeller holder 6 for holding the propeller support 3*b* in a rotatable manner.

The motor box 3*a* has therein an electric motor 3*i* connected via harness 7 to the control unit 4 for driving the propeller shaft 3*d* to rotate together with the propeller elements 3*e* about an axis of the drive shaft 3*d* at a controlled rotation speed, a step motor 3*j* connected via the harness 7 to the control unit 4 for driving the propeller support 3*b* to turn about an axis thereof, causing the propeller shaft 3*d* to turn together with the propeller elements 3*e* about the axis of the propeller support 3*b* at a controlled direction, and necessary gears.

Normally, the axis of the drive shaft 3*d* lies on an imaginary vertical plane including a fore and aft centerline of the boat B, extending in parallel to the centerline.

The propeller holder 6 comprises a swingable member 6*a* swingable at a base end thereof about a fulcrum 6*c* fixed to the bracket 16 fastened to the bow 1*h* of hull 1*a,* and a bearing 6*b* fixed to a distal end of the swingable member 6*a.* The swingable member 6*a* is locked at the distal end to the bow 1*h.* The bearing 6*b* includes vertical roller bearings for rotatably holding the propeller support 3*b,* and top ball bearings for rotatably supporting an unshown flanged part of the propeller support 3*b,* as the flanged part is rotatably engaged therewith.

One can manually unlock the distal end of the swingable member 6*a,* disengage the flanged part of the propeller support 3*b,* pull up the motor box 3*a* together with the propeller support 3*b,* with the foot on the swingable member 6*a,* and turn them back toward the upper deck, together with the propeller holder 6, about the fulcrum 6*c,* so that an entirety of the propeller assembly comes out of water R. The harness 7 comprises a flexible watertight cable 7*a,* along length of at least a part thereof connected to the motor box 3*a.*

The boat B is designed for an even keel trim. It may have a trim by the stern.

The pilot seat may be changed to a pair of port and starboard beam or quarter seats, as the instrument panel 1*d* is changeable to an adaptive one.

The direction sensor 2 may comprise a radio receiver for receiving a directional radio wave transmitted or reflected from a radar, radio transmitter or significant object standing near the fishing point, and a detection circuit for detecting a phase difference between a direction of the radar, transmitter or object and a direction of boat B.

The direction sensor 2 may comprise a light receiver for receiving a laser beam or rays of light emitted, projected or reflected from a light emitter, projector or reflector located near the fishing point, and a detection circuit for detecting a phase difference between a direction of the emitter, projector or reflector and a direction of boat B.

The direction sensor 2 may comprise a sound receiver or sonar for receiving a sound wave transmitted through water R and/or reflected from a sound transmitter or significant object located or standing near the fishing point, and a detection circuit for detecting a phase difference between a direction of the transmitter or object and a direction of boat B.

For use at a fishing point with a slow water flow, the direction sensor 2 may comprise a telescope rotatable about a support fixed to the vessel body 1, and an electric contact fixed to the telescope.

In a modification, the swingable member 6*a* may be formed as an integral part of the bracket 16, and a propeller assembly may be detachably attached thereto.

The bearing 6*b* may be replaced by a motor box having a step motor substituting for the step motor 3*j* in the motor box 3*a.*

In another modification, the propeller support 3*b* may be replaced by a combination of a sound shielding outer tube connected at a watertight lower end thereof to a shaft holder 3*c* turnable thereabout, a drive shaft inserted in the outer tube for turning the propeller shaft 3*d* and the shaft holder 3*c* at a controlled direction, and a drive belt provided along a space between the outer tube and the drive shaft for rotating the propeller shaft 3*d* at a controlled speed.

In still another modification, the outboard motor 3 and the bracket 16 may be removed from the bow 1*h* to the stern 1*g.* In this case, an aft outboard motor (3) may be set aside the aft outboard engine 12 for a concurrent use, or aligned to a fore-and-aft centerline solely for a fishing, when the engine 12 is pulled up on board.

The outboard motor 3 is adaptive as a water flow sensor. Its pair of electric motors serve as a pair of electric generators for generating reaction voltages that represent a flow speed signal and a flow direction signal representing a representative speed and a representative direction of streams of a flow of water R associated with a lower part of the propeller assembly of motor 3, as the vessel body 1 has a vessel direction oriented upstream a water flow and a location manually kept by the motor 3 itself. The outboard motor 3 may be employed as a propelling motor and as a current or flow sensor in an alternative manner. Resultant data may be automatically and directly input to the control unit 4. The boat B may have a forward outboard motor 3 and an aft outboard motor either or both for producing a propulsive force and/or generating a combination of a flow speed signal and a flow direction signal. At an initial stage, the main engine 3 may be concurrently or solely employed to produce a necessary propulsive force.

In yet another modification, the vessel direction control system C1 may be applied to one of a motor boat, a yacht and any small-scale watercraft else having an onboard engine connected to a propeller in water and a steering member interlinked with a helm.

Further, according to the embodiments, as an outboard motor 3 comprises a propelling unit 3*a*+3*b*+3*c*+3*d*+3*e*+6 secured to a bracket member 16 provided at a bow 1*h* of a vessel body 1, a propulsive force of the propelling unit can be efficiently used for controlling a vessel direction.

Further, according to the embodiments, a propelling unit 3 comprises a propeller member 3*d*+3*e*, a first drive (motor 3*i* in the embodiments) connected to a controller 4 for driving the propeller member to rotate about a horizontal axis at a controlled rotation speed, and a second drive (motor 3*j* in the embodiments) connected to the controller for driving the propeller member to turn about a vertical axis at a controlled direction, and hence a vessel body 1 is permitted to have a helmless light-weight propelling unit 3 attached to a bow 1*h*.

The first and and the second drive may be either or both submerged and waterproofed.

Further, according to the embodiments, a propelling unit 3 comprises an electric motor 3*i* as a propulsive force generator, and is free of big noises that may astonish fish.

Further, according to the embodiments, a propelling unit 3*a*+3*b*+3*c*+3*d*+3*e* is detachably attached by a holder 6*a*+6*b*+6*c* to a bracket member 16, and can be carried on board until a boat B arrives near a fishing point.

Further, according to the embodiments, a vessel body 1 has a main outboard engine 12 attached to a stern 1*g*. The main engine 12 is thus allowed to occupy an installation space at the stern 1*g*. The main engine 12 may be operated to assist an auxiliary outboard motor 3, such as when keeping a direction of the vessel body 1 holding a stationary point on fast streams of water R or advancing upstream a flow of water R. The main outboard engine 12 may be replaced by a main outboard motor comprising an electric propulsion motor with or without a helm.

Further, according to the embodiments, a vessel direction detector 2 comprises an azimuth sensor for detecting an azimuth of a bow 1*h* about a midship of a vessel body 1, and is always permitted to know a reference direction, without relying on an external aid such as by light, radio wave or sounds.

Further, according to the second embodiment, a vessel direction control system C2 has a wind velocity detector 13+14 for detecting a velocity (i.e. a magnitude of an average speed and a direction) of winds above a vessel body, and a select switch 8 for selecting a mode of a controller 4 for responding to a detected wind velocity to control an outboard motor 3 so that a bow 1*h* is oriented upstream the winds. Accordingly, a boat B is permitted to have a vessel direction selected in accordance with a type of fishing.

Still more, according to an aspect of the invention, to achieve the object described, a small-scale vessel of which a vessel body has a bow and a stern is provided with a vessel direction control system that comprises a means for detecting a direction of the vessel body as a vessel direction, an outboard motor attached to one of the bow and the stern for controlling the vessel direction, and a control means responsive to a detected vessel direction to control the outboard motor so that the bow is oriented at a preset vessel direction.

As the bow is kept oriented at a direction, the vessel body has a vessel direction maintained irrespective of a wind direction, a wind pressure, or a flow direction of water on which the vessel body is lying. There can thus be achieved a favorable effect in application to a small-scale vessel for a fishing, in particular to a boat for a bass fishing.

While preferred embodiments of the present invention have been described using specific terms, such description is for illustrative purposes, and it is to be understood that changes and variations may be made without departing from the spirit or scope of the following claims.

What is claimed is:

1. A vessel direction control system for a small-scale vessel including a vessel body with a bow and a stern, the vessel direction control system comprising:

a principal propelling outboard engine attached to a stern of a vessel body;

a subsidiary propelling outboard unit attached to a bow of the vessel body and including an electric motor for controlling a direction of the vessel body;

a bracket member fixed to the bow for attaching the outboard unit thereto in a vertically swingable and detachable manner;

a vessel direction detector for detecting the direction of the vessel body as a vessel direction;

a wind velocity detector for detecting a velocity of winds above the vessel body including a component representative of a direction of the winds;

a controller responsive in a first mode thereof, to a detected vessel direction to control the outboard unit so that the bow is oriented at a preset vessel direction, and in a second mode thereof, to a detected wind velocity to control the outboard unit so that the bow is oriented upstream the winds; and a select switch for selecting one of the first and second modes of the controller.

2. A vessel direction control system according to claim 1, wherein the outboard unit comprises:

a propeller member;

a first drive connected to the controller for driving the propeller member to rotate about a horizontal axis at a controlled rotation speed; and a second drive connected to the controller for driving the propeller member to turn about a vertical axis at a controlled direction.

3. A vessel direction control system according to claim 1, wherein the vessel direction detector comprises an azimuth sensor for detecting an azimuth of the bow about a midship of the vessel body.

* * * * *